US005147495A

United States Patent [19]

Douglas

[11] Patent Number: 5,147,495

[45] Date of Patent: Sep. 15, 1992

[54] THERMAL TRANSFER DEVICE

[76] Inventor: James M. Douglas, 2112 Lagoon Dr., Dunedin, Fla. 34698

[21] Appl. No.: 620,907

[22] Filed: Dec. 3, 1990

[51] Int. Cl.[5] ..... B65C 3/12

[52] U.S. Cl. ..... 156/540; 156/234; 156/541; 156/542; 101/8; 101/38.1

[58] Field of Search ..... 156/230, 351, 234, 361, 156/366, 367, 540, 541, 542; 101/8, 38.1

[56] References Cited

U.S. PATENT DOCUMENTS

| | | | |
|---|---|---|---|
| 4,175,993 | 11/1979 | Robertson | 156/540 |
| 4,264,394 | 4/1981 | Izumihara | 156/540 |
| 4,314,814 | 2/1982 | Deroode | 156/234 |
| 4,764,177 | 8/1988 | Sumi et al. | 156/230 |
| 4,980,008 | 12/1990 | Woods et al. | 156/230 |

*Primary Examiner*—Robert A. Dawson
*Assistant Examiner*—David Reifsnyder
*Attorney, Agent, or Firm*—Frijouf, Rust & Pyle

[57] ABSTRACT

An apparatus and method is disclosed for thermally transferring an image from a thin flexible backing containing the image onto an outer cylindrical surface of a cylindrical resilient material. The device comprises a rotatable mount for rotatably holding the cylindrical resilient material. A roller assembly comprising a plurality of rotatable rollers linearly moves the thin flexible backing in accordance with the rotation of the rollers. A positioning device positions the thin flexible backing into contact with the cylindrical resilient material. A heater device applies heat to the thin flexible backing. A motive device moves the thin flexible backing linearly on the roller assembly and rotates the cylindrical resilient material about the axis of the rotatable mount, thereby transferring the image from the thin flexible backing to the outer cylindrical surface of the cylindrical resilient material.

22 Claims, 9 Drawing Sheets

FIG. 14
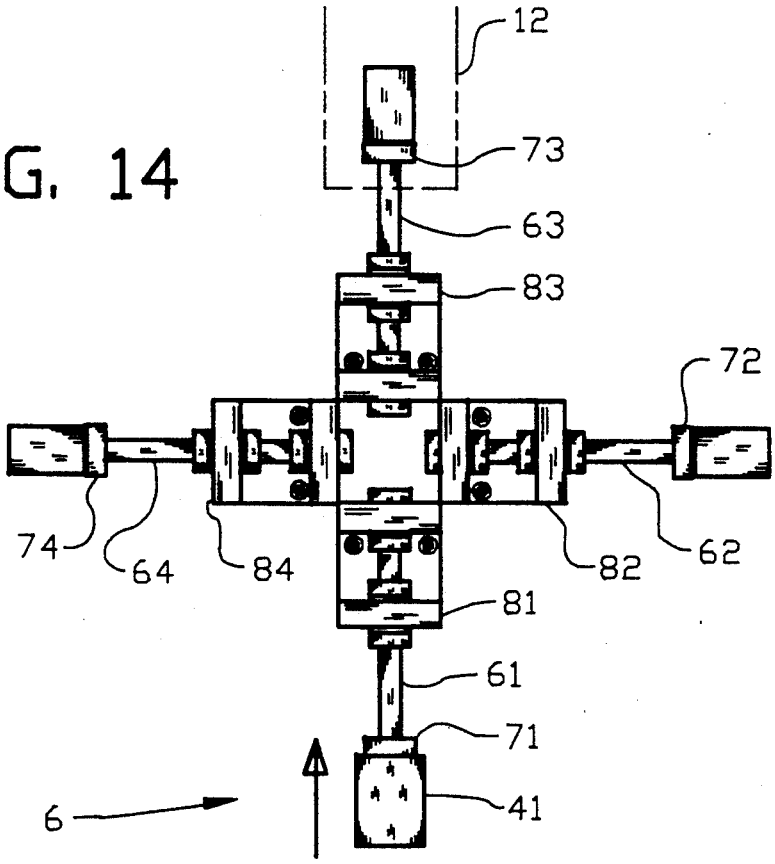
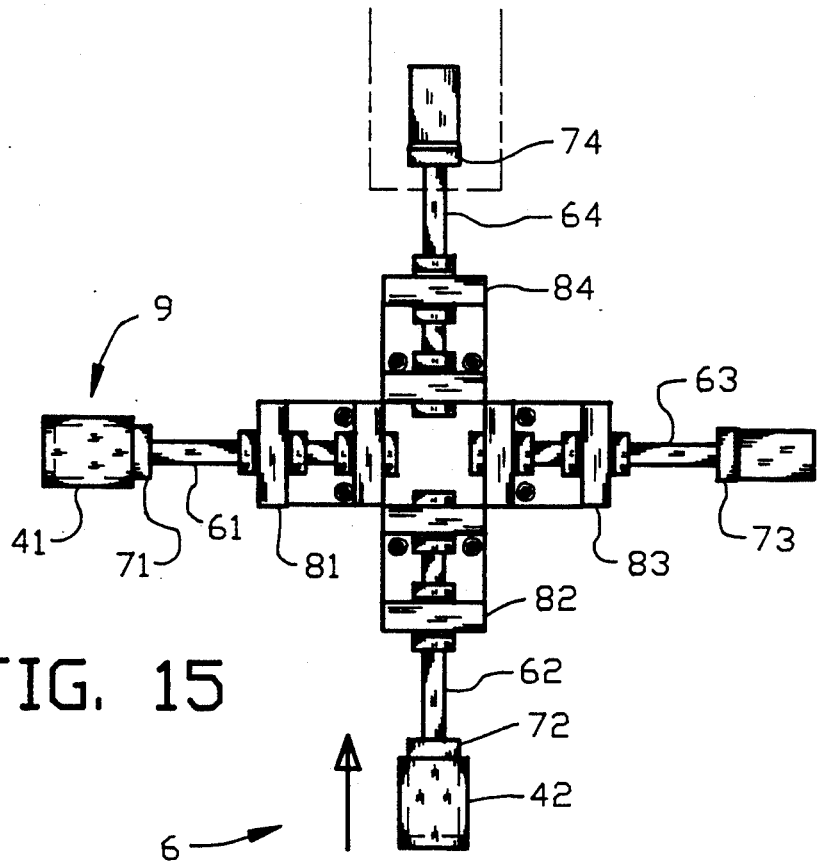
FIG. 15

FIG. 16
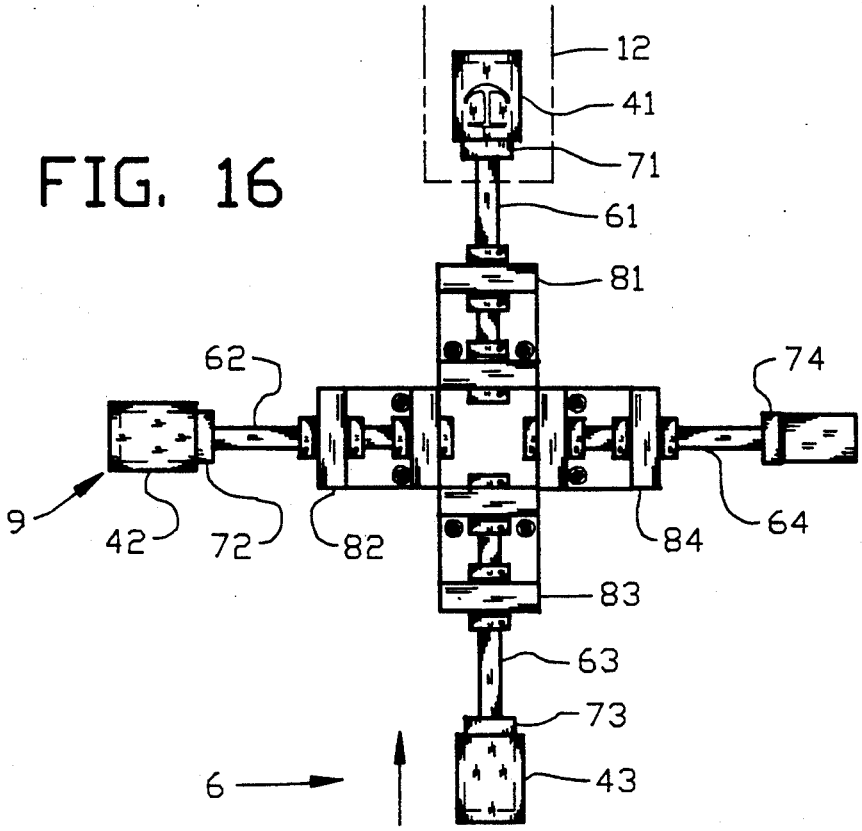
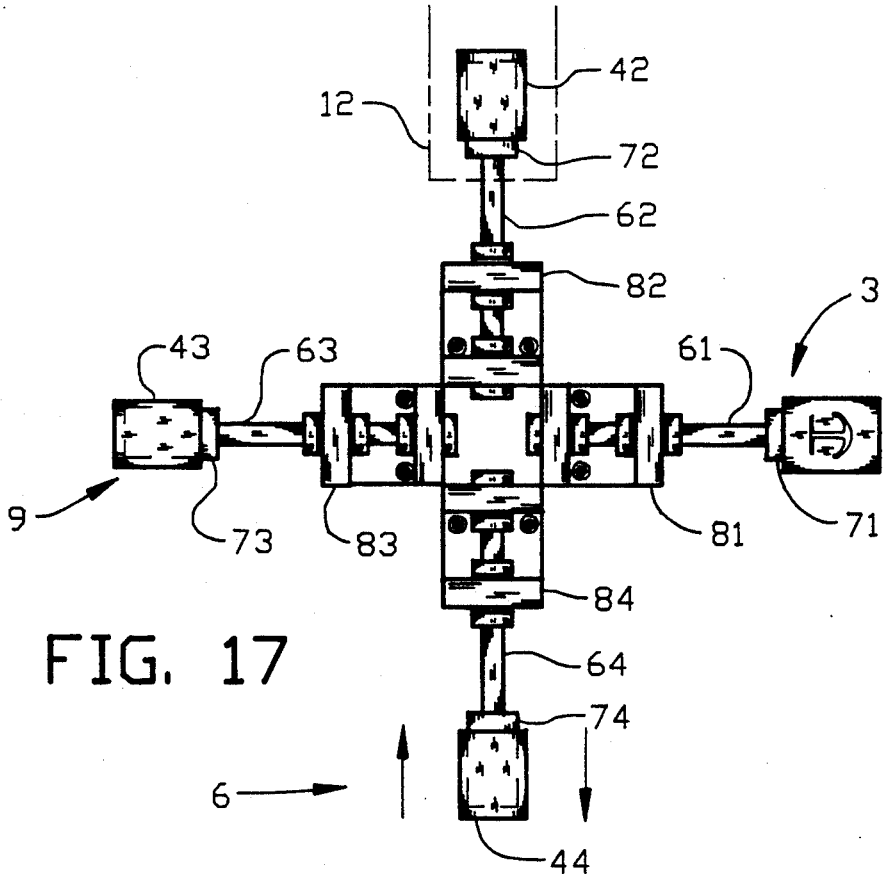
FIG. 17

THERMAL TRANSFER DEVICE

BACKGROUND OF THE INVENTION

1. Field of the Invention

This invention relates to image transfer, and more particularly to an apparatus and method for thermally transferring an image from a thin flexible backing containing the image onto an outer cylindrical surface of a cylindrical resilient material.

2. Information Disclosure Statement

The use of a silk screen process for transferring an image onto an object is well known in the art. A major disadvantage of this process, however, relates to the application of multiple colors The silk screen process allows for the application of only one color at a time. If a multiple-colored image is to be transferred, it is necessary to make as many passes as there are colors. This creates two disadvantages. The first disadvantage is the additional time required to make the additional passes. The second disadvantage is the difficulty of precise alignment, that is, the indexing of the object and the screen so that the object and the screen are properly aligned for the second and subsequent passes. The proper alignment of the second and subsequent passes is critical to insure that the second and subsequent images are properly overlaid.

One specialized area of concern is the image transfer onto a cylindrical resilient material such as an insulating cover for a beverage container of conventional design. The popularity of insulating covers for 12 once cans such as soda cans, juice cans or beer cans has increased over the past years. Furthermore, the popularity of imprinting these insulating covers with advertising material or other material has also increased in recent years. Virtually all of the insulating covers have been imprinted using the silk screen process.

Heretofore, the imprinting of these insulating containers has been restricted to a single color utilizing the silk screening process. The restriction to a single color is due to the fact that the insulating covers are resilient and are incapable of receiving and reliably retaining an index mark. As should be well known to those skilled in the art, an index mark is necessary for multiple printing with different colors using the silk screen process.

The thermal transfer of an image from a thin flexible backing is also well known in the art. This process overcomes the indexing and multiple-pass problems of the silk screen process by allowing for the transfer of a multiple- colored image on one pass. However, the process of thermal transfer of an image from a thin flexible backing onto a cylindrical material which is resilient has not heretofore been reliably accomplished in the prior art. More specifically, the process of thermal transfer of an image from a thin flexible backing onto an insulating cover for a beverage container of conventional design has not heretofore been accomplished in the prior art.

Therefore, it is an object of the present invention to provide an improved apparatus and method for thermally transferring an image from a thin flexible backing containing the image onto an outer cylindrical surface of a cylindrical resilient material.

Another object of this invention is to provide an improved apparatus and method for thermally transferring an image onto a cylindrical resilient material such as an insulating cover for a beverage container of conventional design.

Another object of this invention is to provide an improved apparatus and method for thermally transferring an image onto a cylindrical resilient material which provides permanent and multiple-colored images on an insulating cover for a beverage container of conventional design.

Another object of this invention is to provide an improved apparatus and method for thermally transferring a multiple-colored image onto an insulating cover for a beverage container without the need of index marks.

Another object of this invention is to provide an improved apparatus and method for thermally transferring a multiple-colored image onto an insulating cover for a beverage container which may be mass produced at a cost commensurate with the cost of a single color silk screen process.

Another object of this invention is to provide an improved apparatus and method for thermally transferring a plurality of multiple-colored image onto an insulating cover for a beverage container.

Another object of this invention is to provide an improved apparatus and method for thermally transferring a multiple-colored image onto an insulating cover for a beverage container which provides a permanent and reliable image transfer.

Another object of this invention is to provide an improved apparatus and method for thermally transferring a multiple-colored image onto an insulating cover for a beverage container which may be accomplished in a totally automated process.

Another object of this invention is to provide an improved apparatus and method for thermally transferring a multiple-colored image onto an insulating cover for a beverage container which may be accomplished in a semi-automated process using unskilled workers.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an apparatus and method for thermally transferring an image from a thin flexible backing containing the image onto an outer cylindrical surface of a cylindrical resilient material. The device comprises a rotatable mount for holding the cylindrical resilient material and for allowing the cylindrical resilient material to rotate about an axis of the rotatable mount. A roller assembly comprising a plurality of rotatable rollers holds the thin flexible backing and allows thin flexible backing to move linearly in accordance with the rotation of the rollers. A positioning means moves the thin flexible backing and the cylindrical resilient material into contact with one another. A heating means applies heat to the thin flexible backing. A motive means moves the thin flexible backing linearly on the roller assembly and rotates the cylindrical resilient material about the axis of the rotatable mount, thereby transferring the image from the thin flexible backing to the outer cylindrical surface of the cylindrical resilient material and permanently affixing the image thereto.

In a more specific embodiment of the invention, the roller assembly is attached to a frame, and comprises a feed spool for delivering the thin flexible backing, a take-up spool for receiving the thin flexible backing. A plurality of guide rollers and a guide plate guide the thin flexible backing on the roller assembly. A central rotary member is also attached to the frame, and rotates about a vertical axis. A rotary table is mounted on the central rotary member, and rotates in a horizontal plane. A plurality of mounting brackets are attached to the rotary table, and a plurality of horizontal shafts are attached to the mounting brackets and journaled for rotation thereon. A plurality of rotatable mounts are removably attached to the shafts for holding the cylindrical resilient materials.

The positioning means comprises the central rotary member which is indexed for sequentially moving each shaft, the rotatable mount attached thereto, and the cylindrical resilient material mounted thereon to a position below the roller assembly and thin flexible backing mounted thereon. The heating means is cylindrical and is rotatably mounted on the roller assembly. A pneumatic cylinder moves the roller assembly down from a retracted position to an extended position so that the heating means contacts the thin flexible backing and causes the thin flexible backing to press against the cylindrical resilient material, thereby compressing the cylindrical resilient material.

The cylindrical heating means rotates, causing the rotation of the cylindrical resilient material and the linearly movement of the thin flexible backing on the roller assembly, thereby transferring the image.

The take-up spool rotates causing the linear movement of the thin flexible backing while the roller assembly is in the retracted position, thereby aligning the next image. The movement of the thin flexible backing is indexed and may be controlled by a timer, or a photoelectric eye which senses marks on the back of the thin flexible backing. While the roller assembly is in the retracted position, this indexing allows for the positioning of the image on the roller assembly in preparation for the next transfer.

Control means allow for the setting of the speed of the cylindrical heating means and the thin flexible backing as well as the period the roller assembly remains in the extended position. The control means accommodates various sizes of and the transfer of multiple images onto the cylindrical resilient material.

The invention also resides in the method of thermally transferring an image from a thin flexible backing containing the image onto a cylindrical resilient material, comprising the steps of inserting the cylindrical resilient material upon the rotatable mount, positioning the roller assembly against the cylindrical resilient material with the thin flexible backing containing the image interposed therebetween, heating the thin flexible backing, and rotating the roller assembly thereby causing linear movement of the thin flexible backing and rotational movement of the cylindrical resilient material on the rotatable mount to thermally transfer the image to the cylindrical resilient material.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 14 is a top view of rotatable mounts on shafts, showing a cylindrical resilient material mounted on one of the rotatable mounts;

FIG. 15 is a top view of rotatable mounts on shafts of FIG. 14, rotated clockwise 90 degrees, with two cylindrical resilient materials mounted on two rotatable mounts;

FIG. 16 is a top view of rotatable mounts on shafts of FIG. 14, rotated clockwise 180 degrees, with three cylindrical resilient materials mounted on three rotatable mounts;

FIG. 17 is a top view of rotatable mounts on shafts of FIG. 14, rotated clockwise 270 degrees, with four cylindrical resilient materials mounted on four rotatable mounts;

Similar reference characters refer to similar parts throughout the several Figures of the drawings.

DETAILED DISCUSSION

Figure 1:
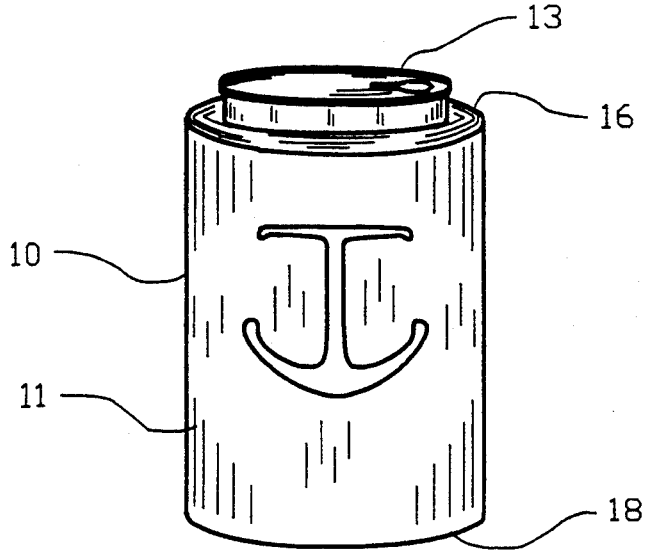
FIG. 1 is an isometric view of a cylindrical resilient material used as an insulating cover for a beverage container, with a typical metal beverage container inserted therein.

FIG. 1 is a perspective view of a cylindrical resilient material shown as an insulating cover or cup 10 for a beverage container 13 of conventional design. In this embodiment, the insulating cover 10 is shown positioned on a conventional twelve-once can 13 such as a soda can, a juice can or a beer can. The insulating cover 10 is commonly referred to as a beverage wrapper sleeve in the trade.

Figure 2:
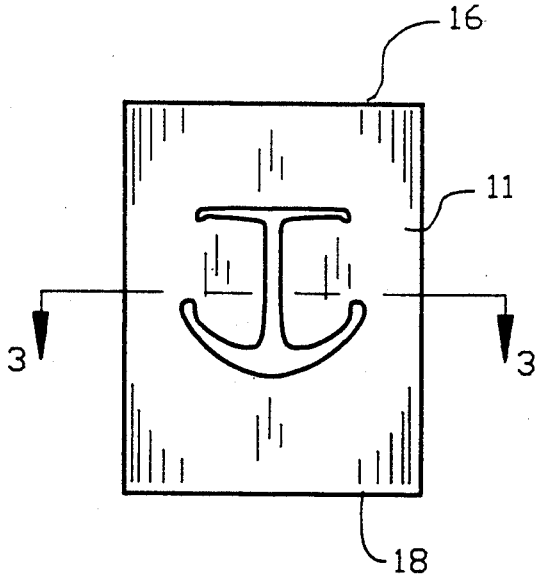
FIG. 2 is a front view of the cylindrical resilient material.
Figure 3:
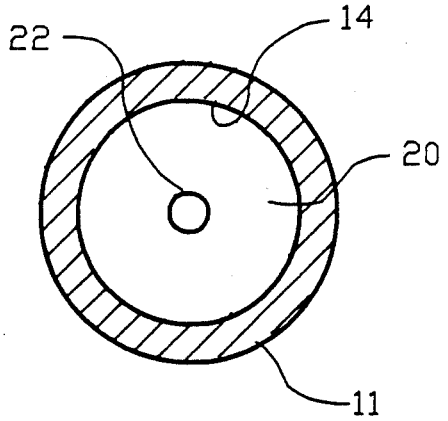
FIG. 3 is a sectional view of the cylindrical resilient material along line 3—3 of FIG. 2.

The insulating cover 10 comprises an outer cylindrical surface 11 and a cylindrical inner portion 14 as shown in FIG. 3, and defines an upper surface 16 and a base surface 18 as shown in FIGS. 1 and 2. A resilient bottom panel 20 defining an aperture 22 is secured to the insulating cover 10 by means such as gluing, heat bonding or the like. The cylindrical inner portion 14 is adapted to frictionally receive the beverage container 13 as shown in FIG. 1 to provide insulation to beverage internal to the beverage container 13. Typically, such insulating covers 10 are made of a closed cell foam material such as polyvinyl chloride or the like.

The insulating cover 10 shown in FIGS. 1-3 has been widely used in the art and is customarily printed with an indicia 24 which may be representative of a product, a place of business, or other advertising material. It has been customary in the prior art to print the indicia 24 on the outer cylindrical surface 11 by a silk-screening process.

Figure 4:
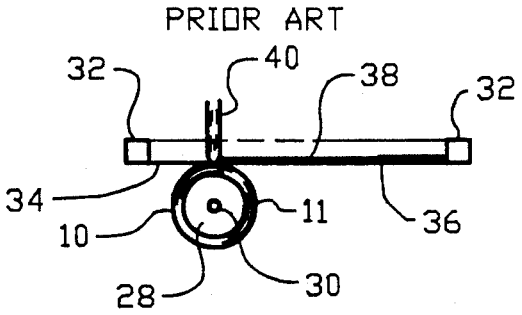
FIG. 4 is a side view of a first step of a prior art silk-screen process for transferring an image onto a cylindrical material.
Figure 5:
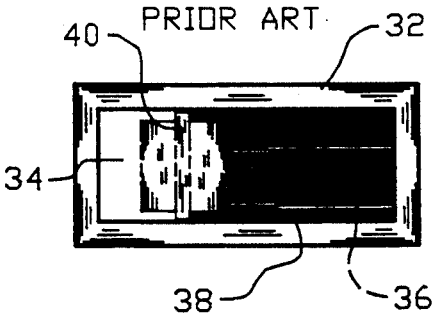
FIG. 5 is a top view of FIG. 4.
Figure 6:
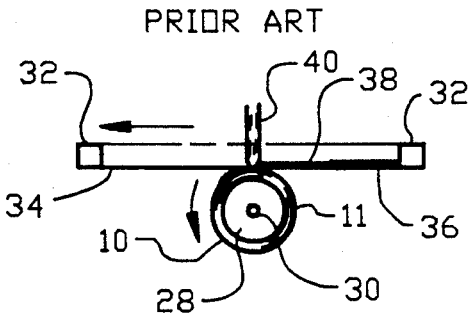
FIG. 6 is a side view of a second step of the prior art silk-screen process for transferring an image onto a cylindrical material.
Figure 7:
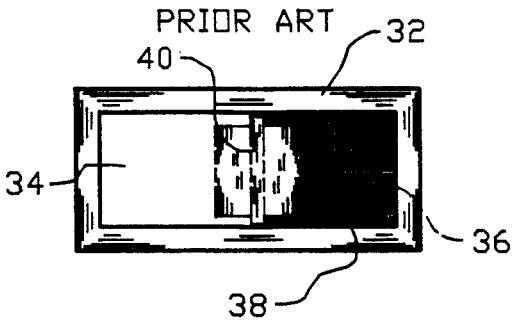
FIG. 7 is a top view of FIG. 6.
Figure 8:
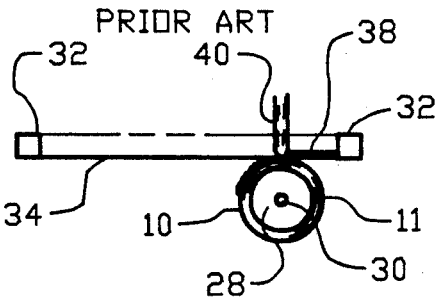
FIG. 8 is a side view of a third step of the prior art silk-screen process for transferring an image onto a cylindrical material.
Figure 9:
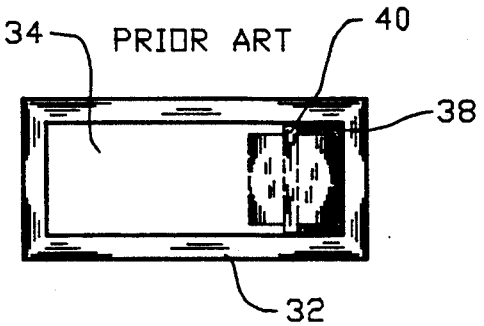
FIG. 9 is a top view of FIG. 8.
Figure 10:
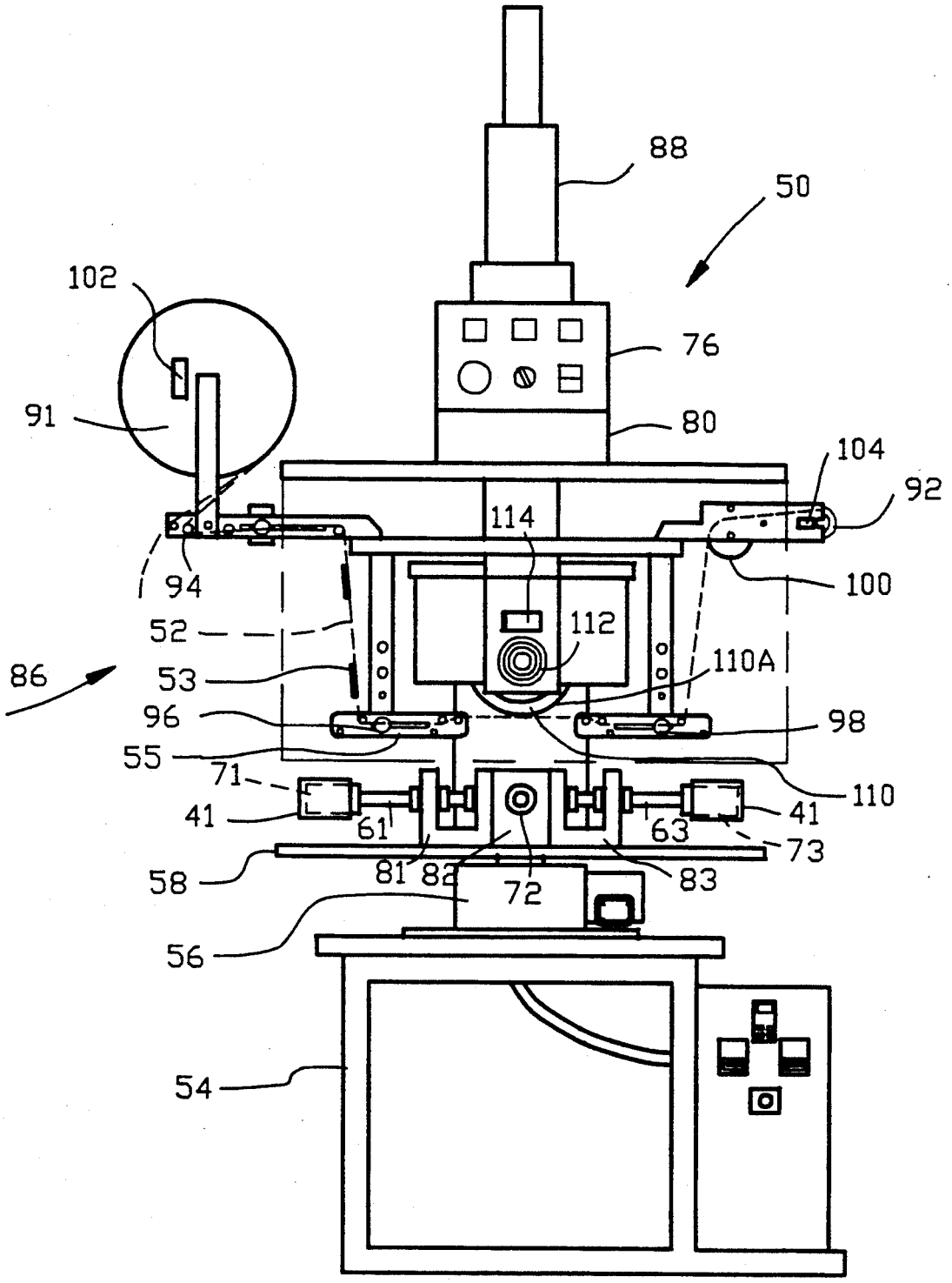
FIG. 10 is a front view of the apparatus of the present invention showing the roller assembly in the retracted position.
Figure 11:
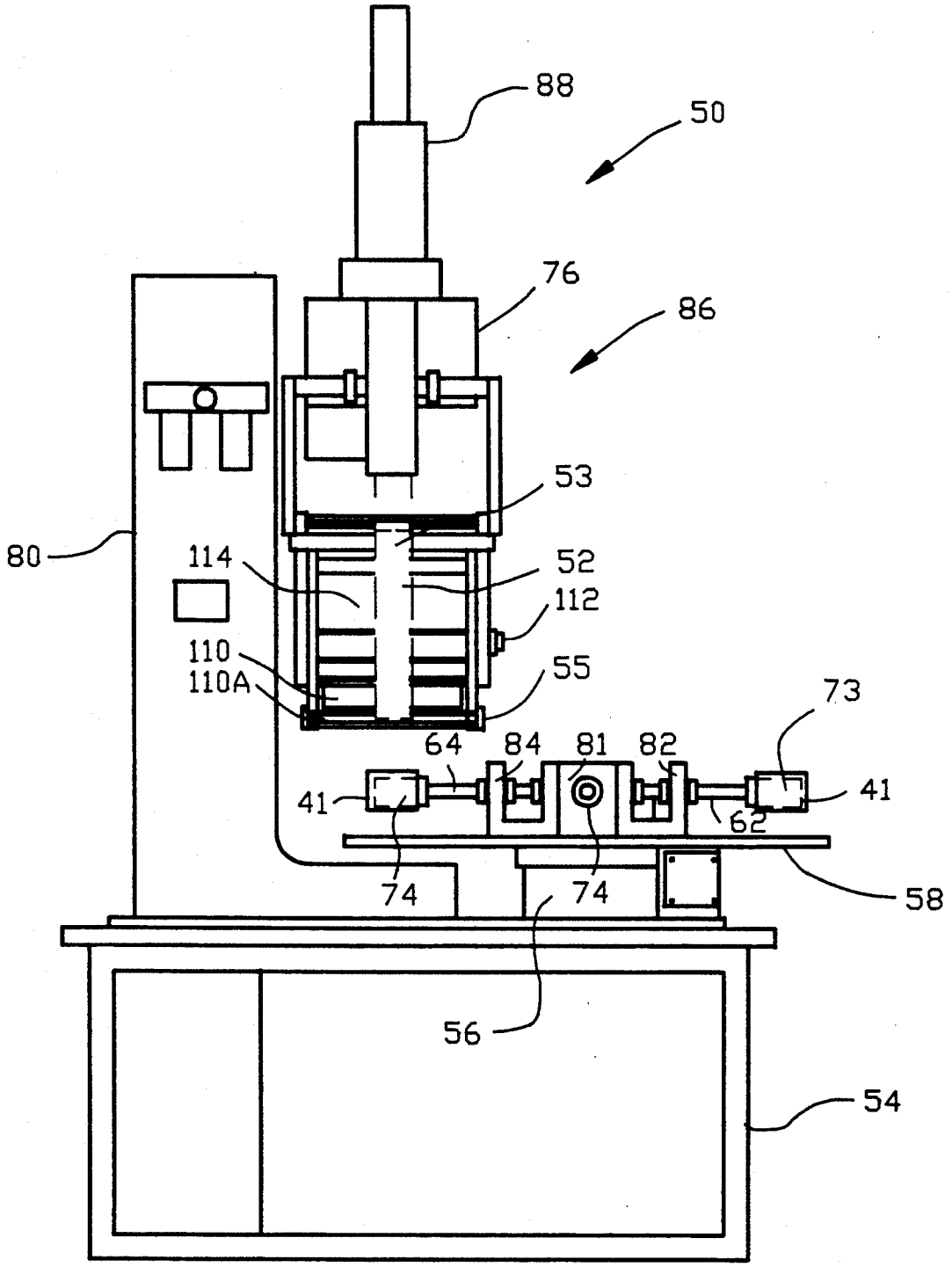
FIG. 11 is a side view of FIG. 10.
Figure 12:
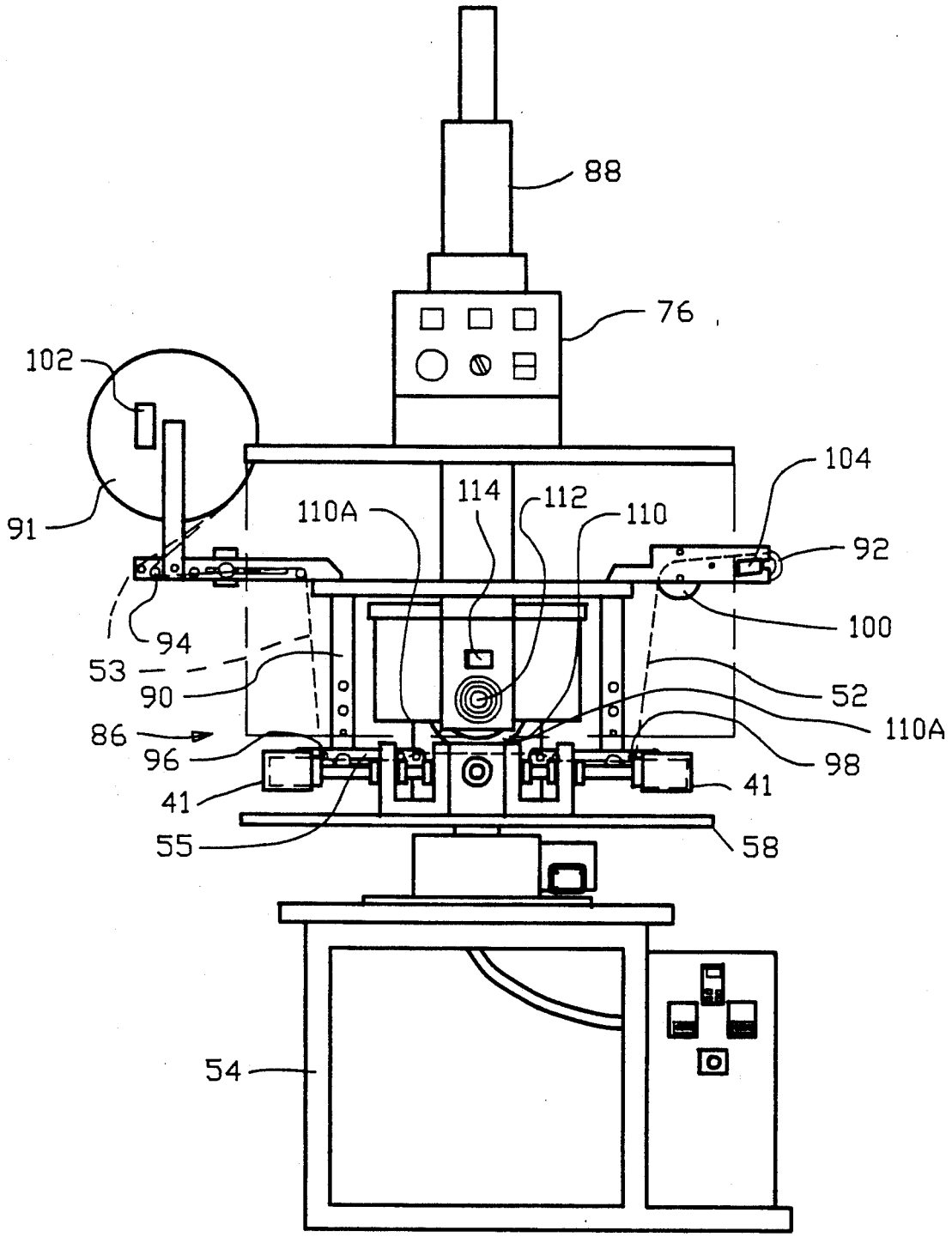
FIG. 12 is a front view of the apparatus of the present invention showing the roller assembly in the extended position.

FIGS. 4-9 illustrate the prior art silk-screen process for imprinting the indicia 24 onto the outer cylindrical surface 11 of the insulating cover 10. As shown in FIGS. 4 and 5, the insulating cover 10 is positioned on a mount 28 being rotatable about a shaft 30 which is fixed to a frame (not shown). A silk-screen frame 32 supports a silk-screen 34 with the silk-screen 34 having an opening 36 in the form of the indicia 24, as should be well known to those skilled in the art. A silk screen blade 40 is fixed to the frame (not shown) such that when the silk-screen frame 32 is moved toward the left as shown in FIGS. 6-9, the silk screen blade 40 forces a silk-screen ink 38 through the opening 36 to transfer the silk-screen ink 38 onto the outer cylindrical surface 11 of the insulating cover 10. Concomitantly therewith, the movement of the silk-screen frame 32 causes rotation of the insulating cover 10 about shaft 30 thereby producing an image in the shape of opening 36 on the outer cylindrical surface 11 of the insulating cover 10.

Although this prior art process has efficiently transferred the silk-screen ink 38 onto the outer cylindrical surface 11 of the insulating cover 10, this process has been limited to the transfer of only a single color silk screen ink 38. As can be appreciated by those skilled in the art, the insulating cover 10 is void of any index marks thereby prohibiting the use of multiple silk-screen operations to produce multiple colored indicia 24. The limitation to a single color is due to the fact that the insulating covers 10 are resilient and are incapable of receiving and reliably retaining an index mark. As should be well known to those skilled in the art, an index mark is necessary for multiple printing with different colors using the silk screen process.

FIGS. 10-13 are front and side elevational views of an apparatus of the present invention for thermally transferring an image 53 from a thin flexible backing shown as a film 52 onto the outer cylindrical surface 11 of the insulating cover 10. An apparatus 50 comprises a frame 54 supporting positioning means shown as a rotatable central rotary member 56. The rotatable central rotary member 56 is shown to include a rotary table 58 which rotates about a vertical axis for rotating the rotary table 58 in a horizontal plane. The rotatable central rotary member 56 may comprise various types of drives as should be well-known to those skilled in the art for enabling the rotary table 58 to rotate in a horizontal plane. Preferably, the rotatable central rotary member 56 intermittently indexes the rotary table 58 within the horizontal plane defined by the rotary table 58.

The rotary table 58 supports a plurality of shafts shown more fully in FIGS. 14-17 as comprising a plurality of shafts 61, 62, 63 and 64. The plurality of shafts 61-64 are attached to the rotatable central rotary member 56 for supporting a plurality of rotatable mounts 71, 72, 73 and 74. Each of the plurality of rotatable mounts 71, 72, 73 and 74 is rotatable in a plane perpendicular to the plane of rotation of the rotary table 58.

More specifically, the shafts 61-64 are journaled for rotation on a plurality of mounting brackets 81, 82, 83 and 84 which are secured to the rotary table 58 to provide support to the shafts 61-64 and to inhibit the flexing thereof. Preferably, the plurality of rotatable mounts 71-74 are removably secured to the shafts 61-64 for enabling rotatable mounts 71-74 of different sizes and dimensions to be substituted therefore. The use of rotatable mounts 71-74 of different sizes and dimensions enables different diameters or heights of the insulating covers 10 to be used with the present invention.

It should be appreciated that the insulating cover 10 on the rotatable mounts 71-74 are free to rotate about a vertical plane and are also indexable about the horizontal plane through the rotation or indexing of the rotatable central rotary member 56. Preferably, the rotation or indexing of the rotatable central rotary member 56 is controlled by a machine controller 76.

The frame 54 also supports an upstanding member 80 for mounting a roller assembly shown generally as 86 by way of positioning means shown as a pneumatic cylinder 88. The pneumatic cylinder 88 moves the roller-assembly 86 between a retracted position shown in FIGS. 10 and 11 and an extended position shown in FIGS. 12 and 13. Preferably, the activation of the pneumatic cylinder 88 to move the roller assembly 86 between a retracted position and an extended position is controlled by the machine controller 76.

The roller assembly 86 comprises a roller frame 90 supporting a feed spool 91 for delivering the film 52 and a take-up spool 92 for receiving the film 52. The film 52 is positioned on a plurality of rotatable guide rollers 94 and a guide plate 55 for holding and guiding the film 52 between an input guide roller 96 and an output guide roller 98. A take-up roller 100 positions the film 52 toward the take-up spool 92. Preferably, the feed spool 91 includes a brake 102 whereas the take-up spool 92 is powered by means shown as a spool power source 104. The spool power source 104 maintains a tension on the film 52 between the feed spool 91 and the take-up spool 92 as well as indexes the film 52 relative to the guide plate 55. Preferably, the activation of the spool power source 104 is controlled by the machine controller 76.

The roller assembly 86 also comprises heating means shown as a rotatable heating roller 110 which is journaled on a shaft 112 mounted to the roller assembly 86. The rotatable heating roller 110 is connected to motive means shown as a roller power source 114 for rotating the rotatable heating roller 110 in a counter-clockwise direction in FIGS. 10 and 12. Preferably, the roller power source 114 is controlled by the machine controller 76 for controlling the rotation of the rotatable heating roller 110 as well as the rotational speed thereof.

In this example, the rotatable heating roller 110 is made of a metallic roller having a plurality of heating elements (not shown) disposed therein for heating an outside surface 110A of the rotatable heating roller 110. If desired, the outside surface 110A may be coated or covered with a release material such as Teflon or other polymeric material or the like. The temperature of the a plurality of heating elements (not shown) as well as the temperature of the outside surface 110A of the rotatable heating roller 110 may be controlled by the machine controller 76.

FIGS. 14–25 illustrate the sequence of operation of the apparatus 50 as shown in FIGS. 10–13. The insulating cover 41 is mounted on the rotatable mount 71 located in a six o'clock position, shown generally as 6, in FIG. 14. This mounting may be performed manually by an operator, or mechanically by an additional mechanism (not shown). The insulating cover 41 is held frictionally on the rotatable mount 71, and is allowed to rotate freely about the axis of the rotatable mount 71. Rotary table 58 is indexed to the next position by rotating the rotary table 58 90 degrees in a clockwise direction, thereby repositioning the insulating cover 41 mounted on the rotatable mount 71 to a nine o'clock position, shown generally as 9, in FIG. 15. This indexing may be performed manually by an operator using controls mounted on the machine controller 76, or automatically. Another insulating cover 42 is mounted on the rotatable mount 72 now located in the six o'clock position 6 in FIG. 15. Rotary table 58 is again indexed to the next position, thereby repositioning the insulating cover 41 mounted on the rotatable mount 71 to a 12 o'clock position 12, and the insulating cover 42 mounted on the rotatable mount 72 to the nine o'clock position 9, as shown in FIG. 16. Another insulating cover 43 is mounted on the rotatable mount 73 now located in the six o'clock position 6 as shown in FIG. 16.

Figure 13:
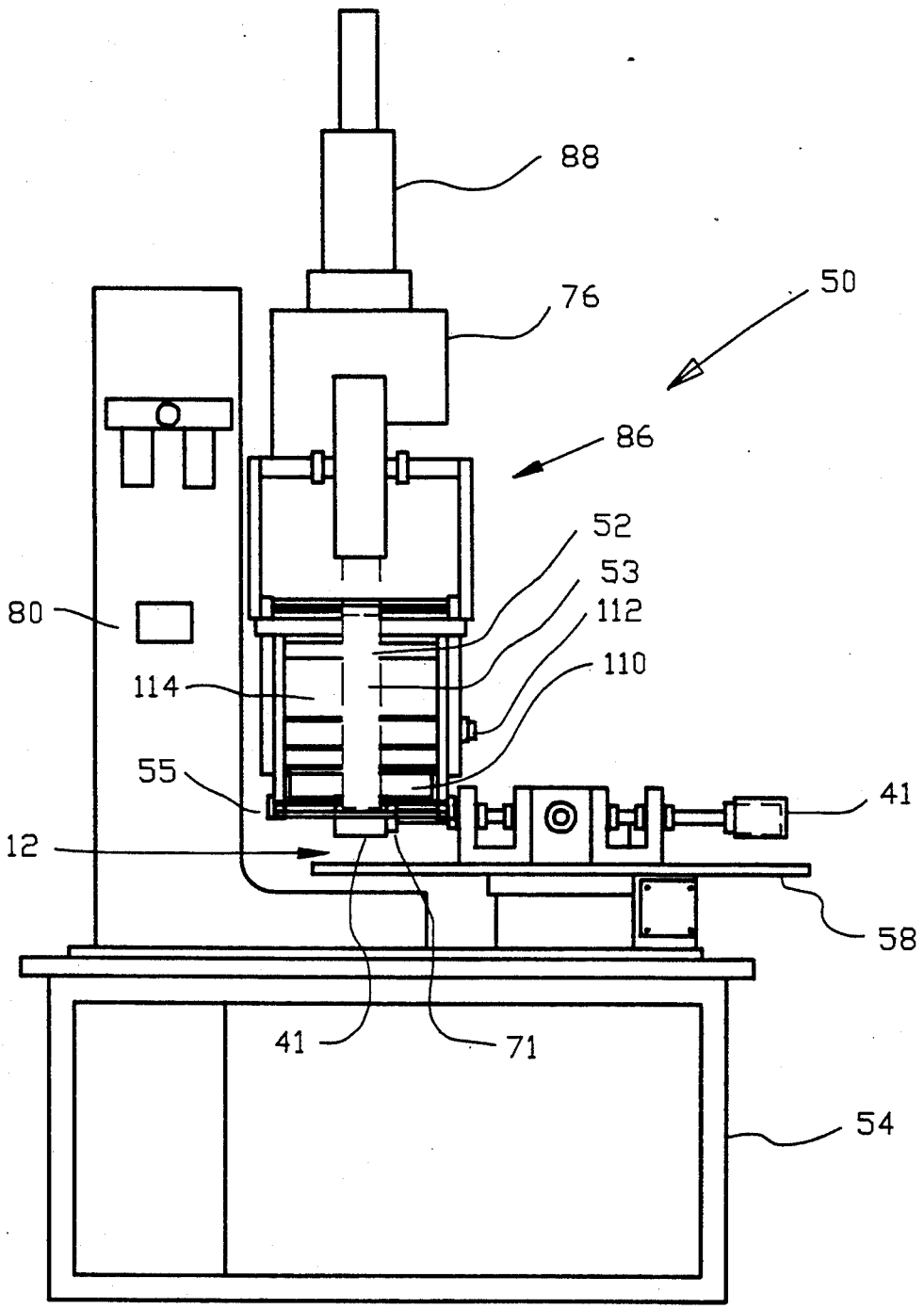
FIG. 13 is a side view of FIG. 12.

The image 53 is then transferred onto the insulating cover 41 as described below and shown in FIGS. 18–25. The twelve o'clock position 12 of rotary table 58 is located directly below the roller assembly 86 and the rotatable heating roller 110 mounted thereon. The rotatable heating roller 110 will contact the insulating cover 41 mounted on the rotatable mount 71 in the 12 o'clock position 12 when the roller assembly 86 upon which the rotatable heating roller 110 is mounted is moved from the retracted position to the extended position as shown in FIG. 13.

Figure 18:
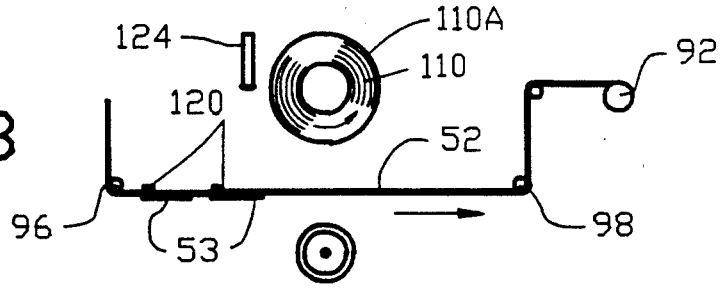
FIG. 18 is a representation of a cylindrical resilient material and a roller assembly in a retracted position, showing selected components thereon in motion.
Figure 19:
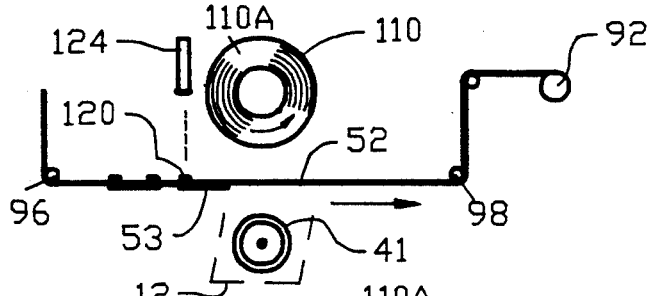
FIG. 19 is a representation of a cylindrical resilient material and a roller assembly in a retracted position, showing selected components thereon in a stationary condition.

FIGS. 18 and 19 illustrate the steps in aligning the image 53 in preparation for the image transfer. As shown in FIG. 18, the spool power source 104 (not shown) rotates the take-up spool 92 thereby drawing the film 52, and the image 53 contained thereon, linearly to the right between input guide roller 96 and output guide roller 98. FIG. 19 shows a photo-electric eye 124 mounted on the roller assembly 86 (not shown) sensing an indexing mark 120 on top side of image 53 and signaling the spool power source 104 (not shown) to cease rotating the take-up spool 92. When the spool power source 104 ceases rotation of the take-up spool 92, the image 53 is aligned above the 12 o'clock position 12 between the rotatable heating roller 110 and the insulating cover 41.

Figure 20:
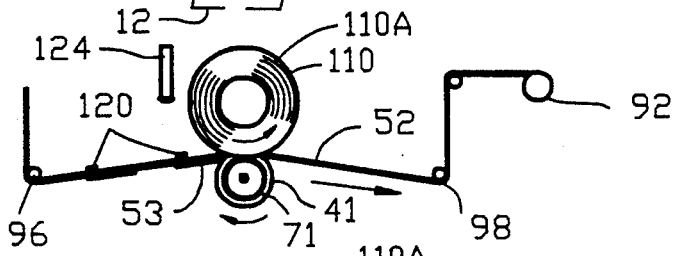
FIG. 20 is a representation of a rotatable heating means in contact with a cylindrical resilient material, and a thin flexible backing containing an image interposed therebetween.
Figure 21:
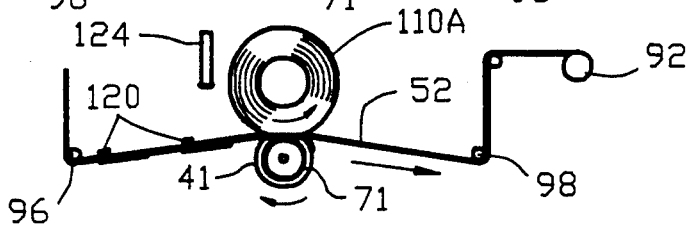
FIG. 21 is a representation of a rotatable heating means in rotating contact with a cylindrical resilient material, and a thin flexible backing containing an image interposed therebetween.
Figure 22:
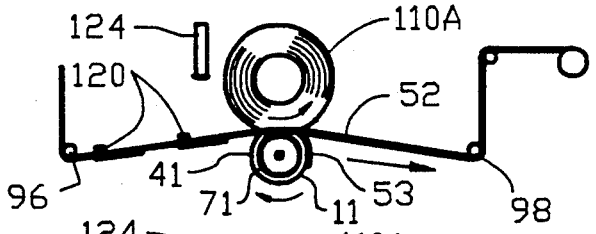
FIG. 22 is a representation of a rotatable heating means in rotating contact with a cylindrical resilient material, and a thin flexible backing containing an image interposed therebetween.
Figure 23:
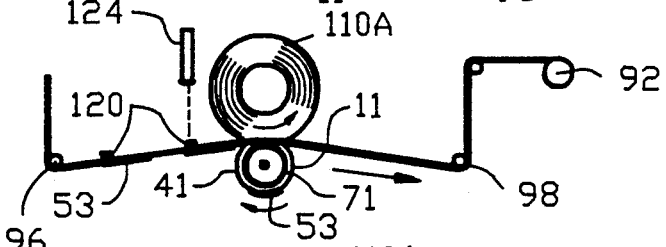
FIG. 23 is a representation of a rotatable heating means in rotating contact with a cylindrical resilient material, and a thin flexible backing containing an image interposed therebetween.

FIGS. 20–24 show the roller assembly 86 in the extended position with the rotatable heating roller 110 in contact with film 52 and the insulating cover 41. In FIG. 20, the pneumatic cylinder 88 has operated, thereby moving the roller assembly 86 along with the rotatable heating roller 110 and film 52 mounted thereon, from the retracted position to the extended position. This operation may be performed manually by an operator using controls mounted on the machine controller 76, or automatically by the controller 76. In this extended position, the rotatable heating roller 110 presses against the insulating cover 41 mounted on the rotatable mount 71 compressing the cylindrical resilient material of the insulating cover 10, and with film 52 and image 53 thereon interposed therebetween. As shown in FIG. 21, the roller power source 114 rotates the rotatable heating roller 110 in a counter-clockwise direction, thereby causing the film 52 to move right and the insulating cover 41 to rotate clockwise about the axis of the rotatable mount 71. Concurrently therewith, the spool power source 104 rotates clockwise the take-up spool 92, as viewed in FIG. 18, thereby assisting the rotatable heating roller 110 in the linear movement of the film 52 and image 53 to the right. The brake 102 on feed spool 91, shown in FIG. 12, maintains tension on the film 52. The application of heat and pressure causes the image 53 on the film 52 to be transferred and permanently affixed to outer cylindrical surface 11 of the insulating cover 41 mounted on the rotatable mount 71 as shown in FIGS. 22 and 23. Upon completion of the transfer of the image 53, a sensor, shown as the photo-electric eye 124, signals the machine controller 76, which causes the roller power source 114 and the spool power source 104 to stop the rotation of the rotatable heating roller 110 and take-up spool 92 to stop the linear movement of the film 52. In the preferred embodiment, the sensor comprises the photo-electric eye 124 capable of detecting the indexing mark 120 on the back of the image 53 as shown in FIG. 23. This method of sensing the indexing mark 120 allows for wide flexibility of operation. The apparatus 50 not only accommodates different sized insulating cover 10, but it can also operate using thin flexible backings having images at different length intervals, or at irregular intervals. It may also be used to apply multiple images to a single insulating cover 10. Alternatively, a timer (not shown) may be used in place of or in addition to the photo-electric eye 124.

Figure 24:
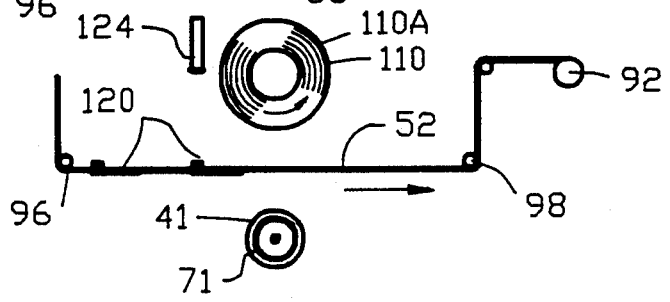
FIG. 24 is a representation of a rotatable heating means in a retracted position from a cylindrical resilient material.

The machine controller 76 then causes the roller assembly 86 to move from the extended position to the retracted position through operation of the pneumatic cylinder 88, thereby disengaging the contact between the rotatable heating roller 110, the film 52, and the insulating cover 41 as shown in FIG. 24.

The rotary table 58 is indexed to the next position, thereby rotating another 90 degrees in a clockwise direction, and moving the insulating cover 41 mounted on the rotatable mount 71 to a three o'clock position shown generally as 3. The insulating cover 42 mounted on the rotatable mount 72 is simultaneously moved to the 12 o'clock position 12 whereas the insulating cover 43 mounted on the rotatable mount 73 is moved to the nine o'clock position 9, and the rotatable mount 74 is moved to the six o'clock position 6, as shown in FIG. 17. The insulating cover 41, containing the newly transferred image, may then be removed from the rotatable mount 71.

The pneumatic cylinder 88 is again operated, lowering the roller assembly 86 from the retracted position to the extended position, and the image-transferring cycle described above is repeated, thereby affixing an image to the insulating cover 42 mounted on the rotatable mount 72 in a like manner as above. Also during this operation of this cycle, another insulating cover 44 is mounted on the rotatable mount 74, now occupying the six o'clock position 6. Upon completion of the image transfer to the insulating cover 42 mounted on the rotatable mount 72, and occupying the 12 o'clock position 12, the roller assembly 86 is again raised.

When the rotary table is indexed back to the six o'clock position, the insulating cover 42 with the new image is removed from the rotatable mount 72 and a new insulating cover is mounted on the rotatable mount 71. The roller assembly 86 is again lowered and the cycle is repeated.

The present invention involves the use of this thermal transfer process specifically for the thermal transfer of an image onto a rotating cylindrical resilient material 10 shown as an insulating cover 10 used for holding and insulating beverage containers. The novelty of this invention relates to the use of the rotary method of application of an image, the cylindrical shape and resilient quality of the image receiving medium of the cylindrical resilient material 10, and the compression which cylindrical resilient material 10 undergoes during the transfer process.

The present invention provides an improved apparatus and method for thermally transferring a multiple colored and permanent image onto an outer cylindrical surface of a cylindrical resilient material without the need of index marks. This invention provides a permanent and reliable single multiple-colored image or a plurality of permanent and reliable multiple-colored images onto an insulating cover for a beverage container at a cost commensurate with the cost of a single color silk screen process. The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for thermally transferring an image from a thin flexible backing containing the image onto an outer cylindrical surface of a cylindrical closed cell resilient material, the closed cell material having an inner cylindrical surface, comprising:

a rotatable cylindrical mount for supporting the inner cylindrical surface to hold the cylindrical closed cell resilient material and for allowing the cylindrical closed cell resilient material to rotate about an axis of said rotatable mount;

a roller assembly comprising a plurality of rotatable rollers for holding the thin flexible backing and for allowing the thin flexible backing to move linearly in accordance with the rotation of said plurality of rotatable rollers;

positioning means for moving one of the thin flexible backing and the cylindrical closed cell resilient material for positioning the thin flexible backing and the cylindrical closed cell resilient material in contact;

said positioning means locating the thin flexible backing against the cylindrical closed cell resilient material and for compressing the cylindrical closed cell resilient material against said cylindrical rotatable cylindrical mount;

heating means for applying heat to the thin flexible backing; and motive means for linearly moving the thin flexible backing on said roller assembly and for rotating the cylindrical closed cell resilient material about said axis of said rotatable mount for transferring the image from the thin flexible backing to the outer cylindrical surface of the compressed cylindrical closed cell resilient material and for permanently affixing the image to the cylindrical closed cell resilient material.

2. An apparatus for thermally transferring an image as set forth in claim 1, wherein said rotatable cylindrical mount is journaled for rotation on a shaft.

3. An apparatus for thermally transferring an image as set forth in claim 1, wherein said rotatable cylindrical mount is removably affixed to a shaft for receiving said rotatable cylindrical mount of one of a plurality of sizes to accommodate the cylindrical closed cell resilient material of a corresponding size; and said shaft is journaled for rotation on a mounting bracket.

4. An apparatus for thermally transferring an image as set forth in claim 1, wherein said roller assembly comprises a feed spool for delivering the thin flexible backing and a take-up spool for receiving the thin flexible backing.

5. An apparatus for thermally transferring an image as set forth in claim 1, wherein said heating means is affixed to said roller assembly; and said positioning means moves said heating means and said roller assembly for positioning the thin flexible backing and the cylindrical closed cell resilient material in contact.

6. An apparatus for thermally transferring an image as set forth in claim 1, wherein said cylindrical rotatable mount is mounted on a shaft; and said positioning means moves said shaft and said cylindrical rotatable mount mounted thereon for positioning the thin flexible backing and the cylindrical closed cell resilient material in contact.

7. An apparatus for thermally transferring an image as set forth in claim 1, wherein said cylindrical rotatable mount is mounted on a shaft;

said shaft is attached to a rotatable central rotary member; and said positioning means comprises said rotatable central rotary member which rotates and is indexed for moving said shaft and said cylindrical rotatable mount mounted thereon for positioning the thin flexible backing and the cylindrical closed cell resilient material in contact.

8. An apparatus for thermally transferring an image as set forth in claim 1, wherein said heating means comprises a rotatable heating means; and said motive means comprises said rotatable heating means.

9. An apparatus for thermally transfrering an image as set forth in claim 1, wherein said roller assembly comprises a take-up spool for receiving the thin flexible backing; and said motive means comprises said take-up spool.

10. An apparatus for thermally transferring an image as set forth in claim 1, wherein said motive means is indexed for allowing the transfer of a plurality of images on the cylindrical closed cell resilient material.

11. An apparatus for thermally transferring an image from a thin flexible backing containing the image onto an outer cylindrical surface of a cylindrical resilient material, comprising:

a frame;

a roller assembly attached to said frame, and comprising a plurality of rotatable rollers for holding the thin flexible backing and for allowing the thin flexible backing to move linearly in accordance with the rotation of said plurality of rotatable rollers;

a rotatable central rotary member rotatably attached to said frame;

a rotary table mounted to said rotatable central rotary member for rotation about a vertical axis enabling said rotary table to rotate in a horizontal plane;

a plurality of shafts attached to said rotatable central rotary member and journaled for rotation thereon;

a plurality of rotatable mounts removably attached to said plurality of shafts, one of said plurality of rotatable mounts for holding the cylindrical resilient material and for allowing the cylindrical resilient material to rotate about the axis of one of said plurality of rotatable mounts;

positioning means for moving one of said plurality of rotatable mounts and said roller assembly for positioning the thin flexible backing held by said roller assembly and the cylindrical resilient material held by one of said rotatable mounts in contact;

a rotatable heating means mounted on said roller assembly for heat transfer; and motive means for linearly moving the thin flexible backing on said roller assembly and for rotating the cylindrical resilient material about said axis of one of said plurality of rotatable mounts for transferring the image from the thin flexible backing to the outer cylindrical surface of the cylindrical resilient material and for permanently affixing the image to the cylindrical resilient material.

12. An apparatus for thermally transferring an image as set forth in claim 11, wherein said roller assembly comprises a feed spool for delivering the thin flexible backing and a take-up spool for receiving the thin flexible backing.

13. An apparatus for thermally transferring an image as set forth in claim 11, wherein said roller assembly comprises a plurality of guide rollers for guiding the thin flexible backing on said roller assembly.

14. An apparatus for thermally transferring an image as set forth in claim 11, wherein said roller assembly comprises a guide plate for guiding the thin flexible backing on said roller assembly.

15. An apparatus for thermally transferring an image as set forth in claim 11, including a plurality of mounting brackets attached to said rotary table; and said plurality of shafts being attached to said plurality of mounting brackets and are journaled for rotation thereon.

16. An apparatus for thermally transferring an image as set forth in claim 11, wherein said positioning means comprises said rotatable central rotary member being indexed for moving said plurality of shafts and said plurality of rotatable mounts mounted thereon for positioning the thin flexible backing and the cylindrical resilient material in contact.

17. An apparatus for thermally transferring an image as set forth in claim 11, wherein said positioning means moves said roller assembly between a retracted position and an extended position such that in said extended position said rotatable heating means contacts the thin flexible backing and causes the thin flexible backing to press against the cylindrical resilient material, thereby compressing the cylindrical resilient material.

18. An apparatus for thermally transferring an image as set forth in claim 11, wherein said positioning means is operated by a pneumatic cylinder.

19. An apparatus for thermally transferring an image as set forth in claim 11, wherein said motive means for rotating the cylindrical resilient material about said axis of one of said plurality of rotatable mounts comprises said rotatable heating means.

20. An apparatus for thermally transferring an image as set forth in claim 11, wherein said motive means for linearly moving the thin flexible backing on said roller assembly comprises said rotatable heating means and said take-up spool.

21. An apparatus for thermally transferring an image as set forth in claim 11, wherein said motive means is indexed for allowing the transfer of a plurality of images on the cylindrical resilient material.

22. An apparatus for thermally transferring an image as set forth in claim 1, wherein said motive means is indexed by means of one of a timer and a photo-electric eye.

* * * * *